United States Patent [19]

Szulewski

[11] 4,057,665

[45] Nov. 8, 1977

[54] ARTIFICIAL TREE STRUCTURE

[76] Inventor: John W. Szulewski, 245 Oakville Ave., Dorval, Quebec, Canada

[21] Appl. No.: 679,076

[22] Filed: Apr. 21, 1976

[51] Int. Cl.[2] ..... A47G 33/06

[52] U.S. Cl. ..... 428/8; 156/61; 211/205; 428/20

[58] Field of Search ..... 428/9-12, 428/17-20, 7-8; D6/105; D11/118; 211/197, 205; 240/10 Q, 10 T; 156/61

[56] References Cited

U.S. PATENT DOCUMENTS

| | | | |
|---|---|---|---|
| 1,683,637 | 9/1928 | Trimpe | 428/8 |
| 3,050,891 | 8/1962 | Thomsen et al. | 428/18 X |
| 3,131,112 | 4/1964 | Abramson | 428/20 X |
| 3,499,818 | 3/1970 | Kent | 428/18 |
| 3,574,102 | 4/1971 | Hermanson | 428/20 X |
| 3,713,957 | 1/1973 | Hermanson | 428/9 |

*Primary Examiner*—George F. Lesmes
*Assistant Examiner*—Henry F. Epstein
*Attorney, Agent, or Firm*—Diller, Brown, Ramik & Wight

[57] ABSTRACT

An artificial tree formed from an elongated trunk member having at least a tubular portion. A plurality of pairs of spaced-apart apertures are provided in the tubular portion. The pairs of spaced-apart apertures lie on an axis which is substantially coextensive to the long axis of the elongated member. A plurality of limb members, each having a connector end provided with engageable means, are detachably secured to a respective pair of the spaced-apart apertures.

6 Claims, 4 Drawing Figures

ARTIFICIAL TREE STRUCTURE

BACKGROUND OF INVENTION a. Field of the Invention

The present invention relates to an improved artificial tree construction and its method of manufacture.

b. Description of Prior Art

The most common type of artificial tree presently known is that utilizing a trunk which is made from an elongated wooden rod having a plurality of angulated holes drilled therein. The holes are provided to receive the free ends of limbs which simulate tree branches. Because the holes are drilled at a fairly steep angle to the long axis of the trunk, the aperture of these holes is relatively weak in a section thereof where the thickness of material between the outer wall of the trunk and the inside wall of the holes is thinnest. Thus, when the free end of the limb is inserted into the hole and the limb is bent to a desired angle, pressure is applied against this weak region and causes a peripheral portion of the hole to break or collapse. Eventually, there is sufficient damage to the stem that it requires replacement.

A further disadvantage of wooden trunks is that these normally are provided in sections and their connecting ends are vulnerable to damage due to the face that the wood can easily break and further, the connecting parts will wear, causing a bad connection resulting in a wobbly motion between both trunk sections.

A still further disadvantage is that it is required that the holes be of a diameter to receive the free end of the limbs in close fit therein whereby to retain the limbs and prevent accidental removal of the limb from the trunk. In view of this requirement, it is sometimes very difficult to insert a limb in a hole or to remove a limb therefrom, particularly if for any reason the stem is subject to moisture. Still further, as pointed out above, when a few of these holes become damaged and can no longer retain a limb, the total appearance of the artificial tree is hindered and therefore necessitating a new trunk section.

SUMMARY OF INVENTION

It is a feature of the present invention to substantially overcome all of the above-mentioned disadvantages.

It is a further feature of the present invention to provide an artificial tree which is sturdy, easy to assemble, and in which the limbs are removably secured thereto in an improved manner.

A still further feature of the present invention is to provide a novel method of manufacturing an artificial tree.

According to the above features, from a broad aspect, the present invention provides an artificial tree formed from an elongated trunk member having at least a tubular portion. A plurality of pairs of spaced-apart apertures are provided in the tubular portion. The pairs of spaced-apart apertures each lie on an axis which is substantially coextensive to the long axis of the elongated member. A plurality of limb members, each having a connector end provided with engageable means, are detachably secured to a respective pair of the spaced-apart apertures.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
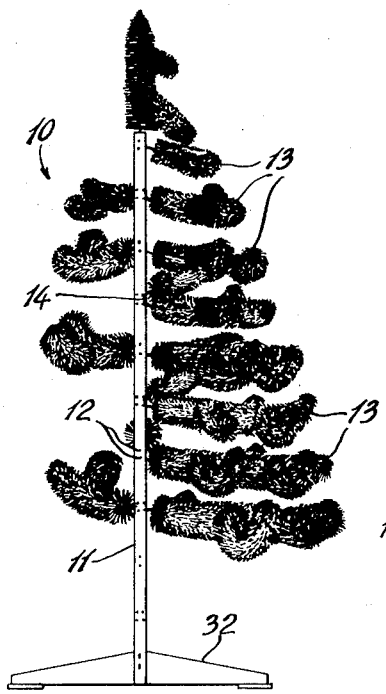
FIG. 1 is a side view of a partially assembled artificial tree of the present invention.
Figure 2:
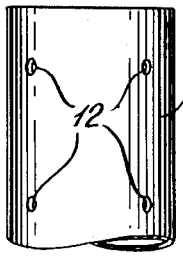
FIG. 2 is a fragmented view of the elongated trunk member showing the attachment of a limb member thereto.

Referring now to the drawings, and more particularly to FIGS. 1 and 2, there is shown generally at 10, the artificial tree of the present invention. The tree 10 is constructed from an elongated trunk member 11 which is provided with at least a tubular portion. As can be seen from FIG. 2, this tubular portion is constituted by the trunk member being formed of an elongated hollow pipe of circular cross-section. A plurality of pairs of spaced-apart apertures 12 are provided and aligned on an axis extending substantially coextensive to the long axis of the elongated member. A plurality of limb members 13 are connected to the pairs of apertures 12 by means of a connector end 14. This is more clearly illustrated in FIG. 2 where it is seen that the connector end is provided with engageable means 15 to secure each of the limb members 13 to a respective pair of spaced-apart apertures 12.

Each limb member 13 is formed by two twisted wire rods 16 and 17. The engageable means 15 is constituted by common end portions of rods 16 and 17, as shown in FIG. 2. One end portion defines a straight rod section 18 and the other end portion extends upwardly from the straight rod section 18 and defines an engageable end portion 19 for abutting retention against the inner wall 20 of the tubular pipe 11. The engageable end portion 19 is formed by a rod section 21 extending substantially transverse to the first or straight rod section 18 and then being bent along a further section 22 which extends substantially in the same direction as the straight rod section 18 and terminates in an upwardly extending end portion 23 extending away and substantially transverse to the rod section 18.

To secure a limb member 13 to the elongated trunk member or pipe 11, the upwardly extending end portion 23 is first inserted in the top one of a pair of apertures 12 until the rod section 22 is in the vicinity of the top aperture 12. The limb member 13 is then angulated downwardly so that the first or straight rod section 18 enters the lower one of the pair of apertures 12. This will secure the limb to the pipe 11 as any downward force applied to the limb prevents detachment from the pipe for the reason that the end portion 23 provides an abutment against the inner surface 20 of the pipe 11. If it is desired to angulate the limb 13 in the position as shown in FIG. 1, downward pressure is applied to the limb to bend it to the desired position. This is made possible due to the fact that the twisted rods are made of formable material, i.e. soft metal. As shown in FIG. 2, the limb is provided with stiff, flexible needle-like strands 24 which are captive by the two twisted rods and extend radially thereabout. Such securement is made by a conventional manner known in the art and does not form part of this invention.

Referring again to FIG. 2, it can be seen that the spacing between the engageable end portion 19 or between the rod section 22 and the straight rod section 18 is substantially equal to the spacing between each aperture of a pair of apertures 12. Also, it can be seen that there is provided a plurality of pairs of spaced-apart apertures, equidistantly spaced, about the tubular pipe 11. In a preferred embodiment, there are five such pairs about a pipe of approximately one and a quarter inch outer diameter. Also, a plurality of pairs of apertures 12 are equidistantly spaced apart along the length of the tubular pipe 11, as shown in FIG. 1.

Figure 3:
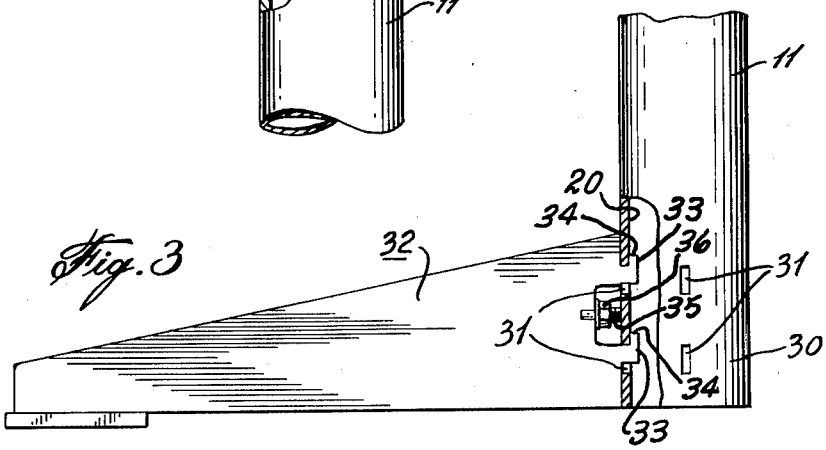
FIG. 3 is a fragmented side view of the lower portion of the trunk member.

Referring now to FIG. 3, there is shown a manner of supporting the pipe 11 substantially vertically above a surface. As hereinshown, the bottom end portion 30 of the pipe is provided with vertically aligned pairs of slots 31, there being at least three or more pairs of such slots about the periphery of the tube 11. Each pair of slots 31 provides attachment of a support leg 32 to the pipe 11. Each leg 32 consists of a flat plate having spaced-apart gripping fingers 33 which are spaced to be received in a pair of slots 31 and retained therein by abutting engagement of a upwardly extending finger portion 34 in abutment with the inner wall 20 of the pipe 11. Clamping pressure is applied between the inner wall of the pipe 20 and the downwardly extending finger portion 34 by means of an adjustable pin 35 displaceably threaded within the support leg 32 for abutment against the outer periphery of the pipe 11. The pin 35 is displaced by a threaded stationary rotatable ring 36, known in the art. Thus, there is provided a rigid stand structure to support the elongated pipe 11 substantially vertically above a surface.

Figure 4:
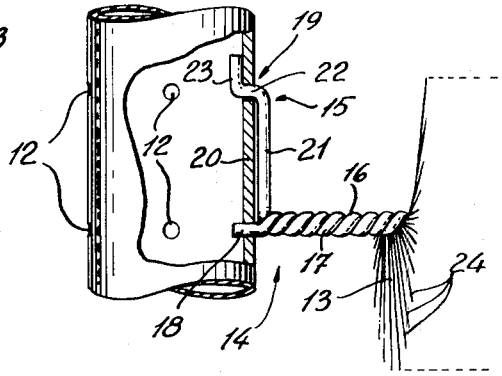
FIG. 4 is a fragmented side view of an interconnecting section of the trunk member.
Figure 4:
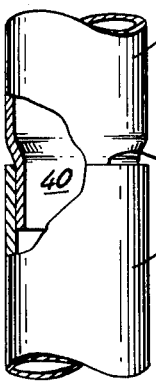

FIG. 4 shows a manner of securing two or more pipe sections to constitute an elongated tubular member 11. As hereinshown, one end 40 of a pipe section 11' is crimped whereby to be received in close frictional contact within an open end 41 of a further pipe section 11''. If it is necessary to positively engage both these ends together, then a lock pin or other device may be provided in the pipe section 11'' adjacent the open end 41 thereto to secure the end 40 to the pipe section 11''.

The manufacturing of the artificial tree 10 of the present invention consists of drilling a plurality of pairs of spaced-apart apertures 12 in an elongated hollow pipe member and forming limb members from two twisted wire rods and leaving the free end of the rods untwisted. This untwisted free end is then placed in a jig which forms these ends to provide the configuration as shown in FIG. 2 and thus constituting an engageable means for connection to the pairs of apertures 12.

It is within the ambit of the present invention to cover any obvious modifications of the preferred embodiment described above. For example, the limb members may be provided with a connector end which is welded or otherwise secured to an end of the limb member. Further, the elongated pipe may be constructed of any suitable material such as plastics and the shape of the apertures 12 may be varied to suit the shape of the engageable means of the connector end. All other obvious modifications of the present invention are intended to be covered provided they fall within the scope of the claims appended hereto.

I claim:

1. An artificial tree comprising an elongated trunk member supportable from a lower end to extend on a vertical axis, said trunk member having at least a tubular portion, a plurality of pairs of spaced-apart apertures in said tubular portion, said pairs of spaced-apart apertures each lying on an axis substantially coextensive to the long axis of said elongated member, a plurality of limb members each having a connector end, said connector end having engageable means constituted by a first rod section and a second rod section extending substantially transverse to said first rod section, said second rod section including an angled rod portion extending substantially in the same direction as said first rod section and terminating in an upwardly extending end portion substantially transverse to said first rod section, said first rod section being locatable in a lower one of a pair of said pairs of apertures, said angled rod portion being engageable within an uppermost aperture of a pair of said pairs of apertures whereby each said limbs can be attached and deteched from said trunk member by vertical arcuate displacement thereof.

2. An artificial tree as claimed in claim 1 wherein each said limb members is formed by two twisted wire rods, and said engageable means being constituted by common end portions of said two rods.

3. An artificial tree as claimed in claim 2 wherein stiff flexible needle-like strands are captive by said two twisted rods and extend radially thereabout, said twisted rods being made of pliable material whereby each limb may be bent at a desired angle from said elongated member when secured thereto.

4. An artificial tree as claimed in claim 1 wherein said elongated member is a hollow tubular member, there being a plurality of pairs of spaced-apart apertures equidistantly spaced about said tubular member and along the length of said tubular member.

5. An artificial tree as claimed in claim 4 wherein said hollow tubular member is a pipe of circular cross-section, three or more pairs of spaced-apart vertically aligned slots adjacent a bottom end of said pipe, a support leg detachably secured to a pair of said spaced-apart slots to support said pipe on said vertical axis.

6. An artificial tree as claimed in claim 5 wherein said pipe is a metal pipe, said pipe being formed of one or more sections interconnected together.

* * * * *